United States Patent [19]

Cole et al.

[11] 4,038,923

[45] Aug. 2, 1977

[54] EXPENDABLE CASE AMMUNITION

[75] Inventors: William T. Cole; Joseph P. Pavone, both of Bridgeport; John J. Scanlon, Monroe, all of Conn.

[73] Assignee: Remington Arms Company, Inc., Bridgeport, Conn.

[21] Appl. No.: 674,142

[22] Filed: Apr. 6, 1976

[51] Int. Cl.[2] ..... F42B 5/02; F42B 7/06

[52] U.S. Cl. ..... 102/43 R; 102/38; 102/49.7; 102/93; 102/42 R

[58] Field of Search ..... 102/38 R, 42 R, 43 R, 102/43 P, 44, 45, 49.7, 49.3, 93, DIG. 1

[56] References Cited

U.S. PATENT DOCUMENTS

| | | | |
|---|---|---|---|
| 1,191,357 | 7/1916 | Snyder | 102/49.7 |
| 3,527,137 | 9/1970 | Scanlon | 102/43 P |
| 3,696,749 | 10/1972 | Scanlon | 102/49.7 |
| 3,712,225 | 1/1973 | Nemylowycz | 102/38 |
| 3,728,966 | 4/1973 | Woodring | 102/43 P |
| 3,741,122 | 6/1973 | Kordas, Jr. | 102/DIG. 1 X |
| 3,776,137 | 12/1973 | Abbott | 102/44 X |

FOREIGN PATENT DOCUMENTS

| | | | |
|---|---|---|---|
| 2,221,991 | 11/1974 | France | 102/38 |

*Primary Examiner*—Harold Tudor

*Attorney, Agent, or Firm*—John H. Lewis, Jr.; Nicholas Skovran; William L. Ericson

[57] ABSTRACT

Expendable case ammunition of the type which is expelled as a unit through the barrel of a firearm and whose case separates from contained projectiles in flight, comprises a body and a cap, and may include a separate projectile container. These parts are made of a deformable material such as plastic, and are snap-locked together. The body has an interior transverse wall separating a projectile chamber from a propellant chamber, which is enclosed by the imperforate cap to permit the use of loose propellant and to protect against contamination and accidental ignition. An anvil is integrally formed in the propellant chamber wall to cooperate with an internal primer and a firing pin which penetrates the cap. A diaphragm region of the cap is ruptured by initiation of the primer, and the cap remains attached to the body during ignition of the propellant and travel of the ammunition unit through the barrel of the firearm.

7 Claims, 7 Drawing Figures

EXPENDABLE CASE AMMUNITION

BACKGROUND AND BRIEF DESCRIPTION OF THE INVENTION

This invention relates to expendable case ammunition, that is, ammunition which is entirely expelled from the chamber and through the barrel of a firearm, and whose case separates from projectiles contained therein after leaving the chamber of the weapon. This eliminates the need to extract and eject a spent case from the chamber of the firearm. Examples of expendable case ammunition appear in U.S. Pats. Nos. 3,527,137 issued Sept. 8,1970 to John J. Scanlon; 3,724,376 issued Apr. 3, 1973 to Martin W. Kordas et al; and 3,741,122 issued June 26, 1973 to Martin W. Kordas, all of which are assigned to the owner of the present application. Such ammunition has many of the advantages of true caseless ammunition, in that it eliminates the costly metal cases of conventional cartridges, or metal heads of conventional shotshells, and simplifies the firearm mechanism. At the same time, it tends to overcome many objections to caseless ammunition, including its fragility, its susceptibility to damage by moisture, the risk of accidental ignition by smokers or by a hot firearm chamber, and the difficulty of forming the propellant to precise dimensions.

According to certain prior work in this field, the propellant may either consist of a solid molded propellant disc containing a percussion-responsive primer pellet, or a hybrid arrangement of loose, granular propellant enclosed in the rear of the case by a molded wafer including propellant and primer compounds. Examples of both types appear in the aforementioned U.S. Pat. No. 3,741,122. The molded propellant disc might consist of powder grains coated with a thermoplastic material such as polyvinyl acetate, and consolidated by compression forming in a heated mold. The molded disc gives the primer a sufficiently rigid support to obtain reliable initiation.

There are several objections to this general approach, however. A propellant disc or wafer is expensive to mold, and is rather fragile for the rough handling to which ammunition is often subject in the field. Further, its exposure at the rear of the case, necessary for initiation by a firing pin, does not resolve the problems of absorption of moisture and of accidental ignition. It is preferable to enclose loose propellant.

An earlier form of expendable case ammunition appears in U.S. Pat. No. 1,191,357 issued July 18, 1916 to Parke T. Snyder. Here, the base of a soft lead case was enclosed by a combustible celluloid disk which would be consumed by the burning propellant. The primer was supported at the center of the celluloid disk by a bridge insert attached to the casing. An extraction rim integrally formed in the lead casing would be deformed to bore diameter as the case was discharged from the chamber. Such a case would suffer from excessive weakness to resist propellant pressures, an objectionably high weight and cost, and the difficulty of handling it without causing permanent deformations which would prevent it being chambered. Further, the low average cross-sectional density resulting from making the projectile integral with a lead case would not give the most desirable ballistic characteristics.

An expendable artillery shell case suitable for use with loose, granular propellant appears in U.S. Pat. No. 3,696,749 issued Oct. 10, 1972 to John J. Scanlon and assigned to the owner of the present invention. This design incorporates a flash tube extending centrally through a main propellant chamber, a primer mounted in a plastic base cap which is vented, molded discs of fast-burning propellant located in the cap vents and connected by lengths of fuse to the primer, polyester film to protect the vents, and flexible metal flaps which cover the vents and are bent outwardly by gas pressure on firing. Such a design is feasible for an artillery shell, but the parts are complex and costly, and the assembly steps required are involved; thus such a design could not be used economically in small-caliber cartridges or shotgun shells, even if it were practical to reduce such an assembly to the small dimensions required while retaining sufficient structural integrity to hold the parts together under gas pressures of the same order of magnitude as those generated in an artillery shell.

It is the general object of this invention to provide improved expendable case ammunition. More specific objects include the reduction of the risks of premature ignition of, and accidental damage to, expendable case ammunition; improvement of the reliability of initiation of this ammunition; and simplification of its manufacture. Another object is to provide improved ammunition of this type which is suitable for use with loose, granular propellant. Further objects and advantages will appear as the following description proceeds.

Briefly stated, according to a preferred embodiment thereof, we carry out the invention in part by forming an ammunition case from at least two components, comprising a body defining a forward projectile chamber and a rearward propellant chamber separated by a transverse wall, and an imperforate cap snap-fitted onto the rear chamber. A third component comprising a projectile container is snap-fitted onto the front of the body for use of the case as a shotshell, but this may be omitted when the case is used with a single bullet. These parts are made of a deformable material, such as plastic or metal. The cap is imperforate, but has a thinned diaphragm portion, which may be reinforced by ribs. A primer is formed on the diaphragm portion to lie within the propellant chamber, so that it is fully enclosed by the assembled case. An anvil is integrally formed in the wall of the propellant chamber, preferably extending axially of the case from the transverse wall, and extends into proximity to the front surface of the primer. To initiate the primer, a firing pin penetrates the diaphragm region of the cap and impacts the primer against the anvil. The explosion of the primer is in itself sufficient to rupture the diaphragm portion of the cap, opening the propellant chamber prior to or concurrent with the ignition of the propellant. This ensures that the subsequently-generated gas pressure can escape rearwardly without tearing the body or separating the cap from it.

DESCRIPTION OF THE DRAWINGS

Referring to FIGS. 1-6, a first embodiment of the invention comprises a shotshell which includes a body 10, a projectile container 14, and a cap 12, all of which are made of a deformable material such as plastic or metal. They may, for example, be formed by injection molding of polyethylene. The container 14 is formed with an internal chamber 15 for a charge of shot 17, or other multiple projectiles, and has a pair of longitudinally-extending diametrally-opposed slots 16 molded into its sidewalls and joining a diametral slot 18 molded across its forward end surface. The slots 16 do not extend entirely through the sidewalls 20 of the container, but a thin web 21 bridges the gap; while the slot 18 preferably extends through the end surface as shown. We have found that this construction results in a reliable opening of the shot container when the ammunition is fired, while having ample integrity to prevent accidental opening prior to firing. Upon leaving the muzzle of a shotgun the two halves of the shot container split and fold open in the manner of a clamshell, hinging apart about thickened sections 22 at the rear end of the container, allowing the shot charge to continue on a normal trajectory as air resistance quickly decelerates the opened container and the attached case and causes them to fall to the ground a relatively short distance from the firearm. A clamshell shot container of a similar general nature is claimed and described in U.S. Pat. No. 3,215,076 issued to D. S. Foote et al on Nov. 2, 1965, and assigned to the owner of this application.

Figure 1:
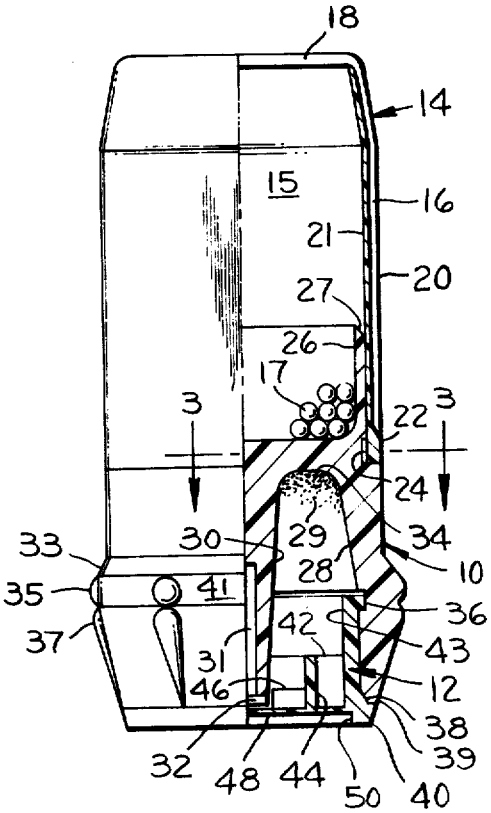
FIG. 1 is a view in side elevation, and partially in cross-section, of a shotshell according to a first embodiment of the invention, shown without a primer.
Figure 2:
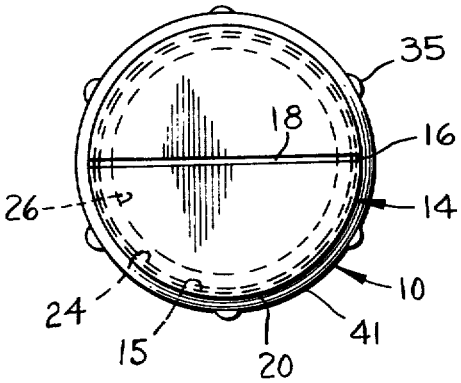
FIG. 2 is a top plan view of the shotshell.
Figure 4:
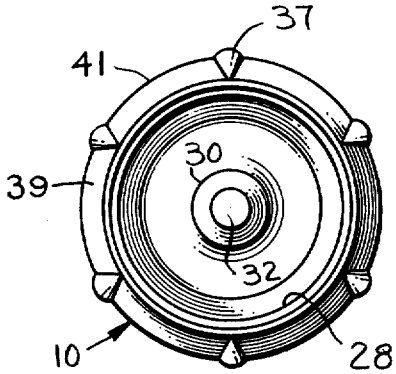
FIG. 4 is a bottom plan view of the shotshell with a cap member thereof removed.
Figure 3:
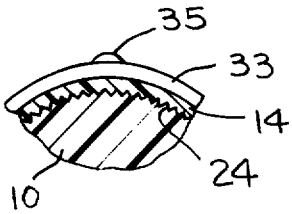
FIG. 3 is a fragmentary sectional view taken along line 3–3 in FIG. 1, looking in the direction of the arrows.
Figure 5:
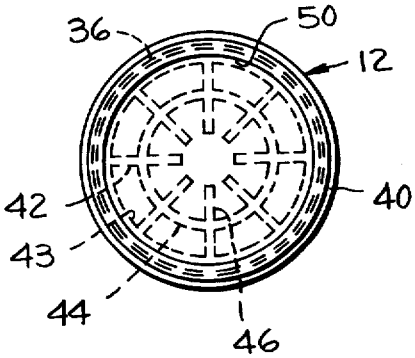
FIG. 5 is a bottom plan view of the cap member.

The body 10 has an imperforate, thickened transverse wall 34 separating the forward shot chamber 15 from a rearward propellant chamber 28, which is filled with loose, granular propellant 29, such as conventional smokeless powder of a suitable type. A tubular forward extension 26 cooperates with the interior of the shot container 14 to prevent the parts from becoming canted in handling, while an interior serrated flange 24 formed at the base of the shot container engages in a mating serrated recess in the body 10 to prevent relative rotation or axial separation.

An anvil 30 is molded integrally into the body 10, taking the form of a column extending axially and rearwardly from the wall 34 into proximity to the forward surface of a primer 52 (FIG. 6) contained in the cap 12. We have found that the reliability of initiation of the primer is improved by providing a metal surface 32 at the rear end of the anvil, and this is afforded in the illustrated embodiment by a metal pin 31 inserted in the plastic anvil 30.

The cap 12 has a tubular rim portion 43 which is conformably received in the rear of the chamber 28, and terminates in a circumferential flange 36 which forms a snap fit in a corresponding recess in the chamber wall. A thickened, tapered portion 38 joins the tubular portion 43 with an annular base extension 50, which protrudes rearwardly of an imperforate, thinned, central diaphragm portion 48 to protect this portion from accidental injury or puncture. Insertion of the cap 12 into the base of the body 10 completely encloses and seals the chamber 28, thereby protecting the chamber from moisture and other contaminants, and obviating the risk of accidental ignition of the internally-contained propellant 29 and primer 52.

The central diaphragm portion 48 of the cap is made sufficiently thin to insure that the primer 52 can of itself generate sufficient pressure to rupture it, before the propellant 29 has ignited, or at least prior to the buildup of the full propulsive pressure. If the portion 48 is so strong that it does not burst until the propellant is fully ignited, the pressure might tear the cap 12 or expel it from the body 10, leaving bits of plastic in the firearm to interfere with chambering and firing the next round. We have found a thickness of about 8 mils suitable for the central portion of a polyethylene cap. It is not, however, necessary for the entire area of the base closure to be this thin and weak, and it is preferable for purposes of protection against premature rupture to reinforce a limited area of it. We therefore mold the cap with a reinforcing ring 44, and with circumferentially-spaced ribs 42 and 46 respectively extending radially outwardly from the ring to join the tubular portion 43, and radially inwardly toward the anvil column 30.

Figure 6:
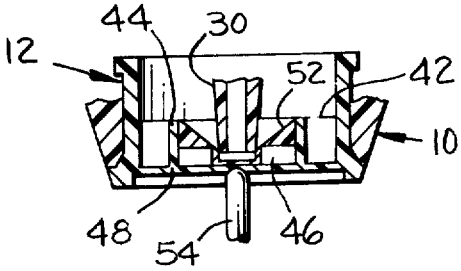
FIG. 6 is a sectional view in side elevation of the cap member with a primer assembled therein.

As shown in FIG. 6, the primer 52 is seated within the ring 44, and extends between the anvil 30 and the center of the diaphragm portion 48. The primer may be formed in situ by tamping a suitable conventional impact-sensitive primer composition into the illustrated form, with an inverted conical recess for accommodating the anvil, and applying a foil (not shown) to its upper surface. The anvil extends into close proximity to the diaphragm, leaving only a thin layer of primer composition between these parts to insure reliable initiation. To fire the shotshell, a firing pin 54 having a rounded tip is driven forwardly into the center of the diaphragm p ortion 48, penetrating the thin plastic and impacting the primer against the anvil 30. It should be noted that a firing pin with a flat or conical tip will probably not be satisfactory, since it may blank out a piece of plastic which remains between the firing pin and the primer and prevents primer ignition.

Loading of the shotshell is preferably carried out with the parts in positions inverted from those illustrated, the shot charge 17 first being deposited in the shot container, and the body 10 then being inserted into snap-fitted relation to the flange 24. A tapered lip 27 at the forward end of the body helps to guide it into the interior of the shot container. The propellant 29 is then deposited in the rear chamber 28, and the primed cap 12 is inserted into snap-fitted relation to the body 10. Assembly is thus quite simple, and may be performed by conventional shell loading machines without re-inverting any of the parts.

The exterior of the shotshell may assume various forms, but requires some means for restraining it in a fixed position in the firearm chamber as the firing pin penetrates the cap and detonates the primer, and also a means by which an extractor may grip any round that is not fired. In the preferred form, a frusto-conical shoulder 33 provides the necessary restraint, in cooperation with a mating neck (not shown) in the chamber of the firearm. A circumferentially-spaced series of dimples 35 around a cylindrical section 41, and a series of teardrop protrusions 37 around a frusto-conical base section 39, cooperate with a suitably-designed extractor (not shown) to permit removal of unfired rounds from the firearm chamber. The outer circumferential surface 40 at the base of the cap 12 is tapered to conform to the body section 39.

In a manner known per se, the shoulder 33 and the sections 41 and 39 are squeezed into the bore of the firearm as the shell leaves the chamber. The restraint provided by the shoulder 33 not only serves to hold the primer against the blow of the firing pin, but also improves the ballistic performance of the shell by delaying its departure from the chamber until the ignition of the propellant has built up a substantial gas pressure.

Figure 7:
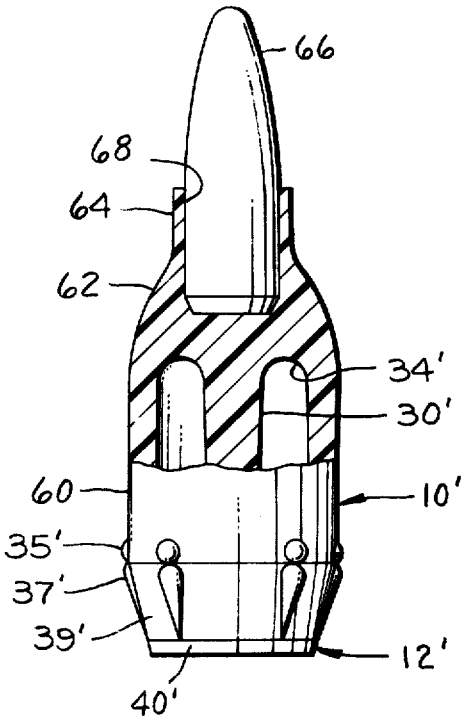
FIG. 7 is a view in side elevation, and partially in cross-section, of a cartridge according to another embodiment of the invention.

Another embodiment of the invention in a center fire cartridge is shown in FIG. 7, parts similar to those of the preceding embodiment being similarly numbered, with prime superscripts. No separate projectile container is needed for this type of ammunition; instead, the body 10' is extended forwardlyfrom a generally cylindrical section 60 into a bottleneck 62 and thinned mouth section 64, and a mouth recess 68 receives a bullet 66. The cap 12' and the rear portion of the body 10' may be substantially like those of the preceding embodiment, with appropriate adjustment of the volume of the propellant chamber 34', and suitable selection of propellant and primer, to suit accepted practice for this type of ammunition. In this case as with the shotshell described before, the enlarged portions of the case at 62 and 60 provide initial restraint, and are squeezed into the bore of the firearm as the cartridge departs from the chamber.

The construction of either of the illustrated embodiments provides a means for omitting the conventional metallic primer cup and battery cup from the primer, as the ring 44 and the interior region of the diaphragm portion 48 provide a form in which a loose mass of explosive compound may be formed in situ into the primer 52. The body 10, anvil column 30, and cap 12 all being symmetrical about the common longitudinal axis of the ammunition case, the anvil is automatically aligned in front of the primer by the act of attaching the cap to the body.

Either or both of the body 10 and the cap 12 may alternatively be made of a metal, such as aluminum, provided that they will deform readily enough to permit the shoulder 33 to be squeezed into the bore of the firearm as the ammunition case departs from the chamber, but nevertheless have satisfactory resistance to accidental denting or other deformation while being carried before firing. The cap must also be capable of assembly with the body without becoming permanently deformed. In the event that the cap is metallic, the firing pin may have a flattened rather than rounded tip if desired, since a blanked-out piece of a cap made of metal, as opposed to plastic, would not unduly inhibit detonation of the primer.

What we claim is:

1. Expendable case ammunition comprising:

a body having an imperforate transverse wall therein separating and defining a forward chamber for containing projectile means and a rearward chamber terminating in a rearwardly-facing opening and adapted to contain a quantity of propellant;

imperforate cap means attached to the rearward end of said body and sealing said rearward chamber prior to firing of the ammunition, said cap means being formed as an integral body of substantially non-combustible material;

primer means and anvil means adjacent to said cap means within said rearward chamber;

said cap means having a thickened tubular rim portion attached to said body and spanned by a transverse diaphragm portion having thickened reinforcing regions joining said rim and a thinned region penetrable by a forwardly-moving firing pin for initiating said primer means, said thinned region being rupturable by pressure generated by said primer means within said rearward chamber upon initiation of said primer means to open said rearward chamber prior to the establishment therein of the full pressure generated by ignition of said propellant, for propulsion of said body and cap as a unit by ignition of said propellant.

2. Ammunition as recited in claim 1, said anvil means being formed of plastic material, together with a metallic element attached to said anvil means and interposed between said anvil means and said primer for impact by said firing pin.

3. Ammunition as recited in claim 2, said metallic element comprising a pin extending longitudinally into said column and having an impact surface rearwardly confronting said primer.

4. Ammunition as recited in claim 1, said reinforcing regions comprising ribs circumferentially spaced apart about said diaphragm portion and joining said rim portion.

5. Ammunition as recited in claim 4, said reinforcing regions further including a ring located centrally of said diaphragm portion, said ribs joining said ring about an outer periphery thereof, said thinned region spanning said ring and areas of said diaphragm portion lying circumferentially between said ribs.

6. Ammunition as recited in claim 1, in which said anvil means comprises a column secured to said body and extending within said rearward chamber into proximity to said cap means, said primer means being interposed between said anvil means and cap means, said thinned region covering said anvil means and primer means and also including a larger area of said transverse diaphragm portion, whereby rupture of said thinned region opens said rearward chamber over a larger rearward area than is occupied by said anvil means and primer means.

7. Ammunition as recited in claim 3, in which said reinforcing regions include a ring surrounding said primer means, and having an inner circumference whose area is spanned by said thinned region and covers said anvil means and primer means and also includes a larger area of said diaphragm portion.

* * * * *